US011871854B2

(12) United States Patent
Barbalinardo et al.

(10) Patent No.: US 11,871,854 B2
(45) Date of Patent: Jan. 16, 2024

(54) ADJUSTABLE FEEDING UNIT

(71) Applicant: Acute Baby Co., Royersford, PA (US)

(72) Inventors: Wendy Barbalinardo, Royersford, PA (US); Michael Barbalinardo, Royersford, PA (US)

(73) Assignee: ACUTE BABY CO., Royersford, PA (US)

( * ) Notice: Subject to any disclaimer, the term of this patent is extended or adjusted under 35 U.S.C. 154(b) by 0 days.

(21) Appl. No.: 18/326,573

(22) Filed: May 31, 2023

(65) Prior Publication Data

US 2023/0389719 A1 Dec. 7, 2023

Related U.S. Application Data

(60) Provisional application No. 63/348,508, filed on Jun. 3, 2022.

(51) Int. Cl.

| | |
|---|---|
| ***A47D 13/08*** | (2006.01) |
| ***A47G 9/10*** | (2006.01) |
| ***A47G 9/02*** | (2006.01) |

(52) U.S. Cl.

CPC ..... *A47D 13/083* (2013.01); *A47G 9/10* (2013.01); *A47G 9/0253* (2013.01); *A47G 2009/1018* (2013.01)

(58) Field of Classification Search

CPC ..... A47D 13/083; A47D 13/08; A47G 9/10; A47G 2009/1018; A47G 9/0253; A47G 9/0238

USPC ..... 5/640, 645, 636, 490, 655, 657, 652

See application file for complete search history.

(56) References Cited

U.S. PATENT DOCUMENTS

| | | | | |
|---|---|---|---|---|
| 2,314,080 | A * | 3/1943 | Dine et al. | A61G 7/065 128/845 |
| 4,392,489 | A * | 7/1983 | Wagner, Sr. | A61F 5/0193 D24/190 |
| 4,805,605 | A * | 2/1989 | Glassman | A61F 5/0193 128/882 |
| 5,133,098 | A * | 7/1992 | Weber | A47G 9/10 5/655 |
| 5,269,322 | A * | 12/1993 | Mandel | A61F 5/3715 128/845 |
| 5,448,790 | A * | 9/1995 | Saro | A47C 17/045 5/632 |
| 6,145,508 | A * | 11/2000 | Seip, Jr. | A47C 20/021 128/845 |
| 6,564,408 | B2 * | 5/2003 | Van Vuuren | A47D 5/00 5/655 |
| 6,651,282 | B1 | 11/2003 | Skoug et al. | |
| 6,857,150 | B2 | 2/2005 | Matthews Brown | |
| 7,111,347 | B1 | 9/2006 | Cottrell | |
| 8,156,941 | B1 * | 4/2012 | Simms | A61G 7/1098 128/845 |
| 9,138,072 | B1 * | 9/2015 | Sanders | A47G 9/0253 |

(Continued)

*Primary Examiner* — Robert G Santos

(74) *Attorney, Agent, or Firm* — Sagacity Legal, PLLC

(57) ABSTRACT

An adjustable feeding unit for providing support during a feeding activity. The adjustable feeding unit includes a stack of a plurality of positioning elements mounted one over the other such that the positioning elements define a base surface and an angularly raised surface disposed at an angular offset with respect to the base surface. One or more positioning elements are removable from the stack to adjust the angular offset between the base surface and the angularly raised surface.

19 Claims, 15 Drawing Sheets

(56) References Cited

U.S. PATENT DOCUMENTS

| | | | | |
|---|---|---|---|---|
| 2002/0023301 | A1* | 2/2002 | Vuuren | A47D 5/00 5/655 |
| 2006/0096031 | A1 | 5/2006 | Foster | |

* cited by examiner

ADJUSTABLE FEEDING UNIT

CROSS-REFERENCE TO RELATED APPLICATIONS

The present application claims the benefit of U.S. Provisional Application No. 63/348,508, filed Jun. 3, 2022, entitled "Adjustable Feeding Unit" which is incorporated by reference herein in its entirety.

BACKGROUND OF THE INVENTION

When nursing or feeding (for example, breastfeeding or bottle feeding) an infant, suboptimal positioning of the infant increases the incidence of digestive difficulties. This is discomforting for both the infant and the infant's caregiver. To improve an infant's positioning, a caregiver typically needs to elevate the infant's head above its stomach such that the infant is feeding at or close to the optimal feeding angle. To attain the optimal feeding angle, a caregiver generally supports the infant with their arms and/or wrists. However, prolonged feeding durations strain the arms and/or the wrists of the caregiver.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1A:
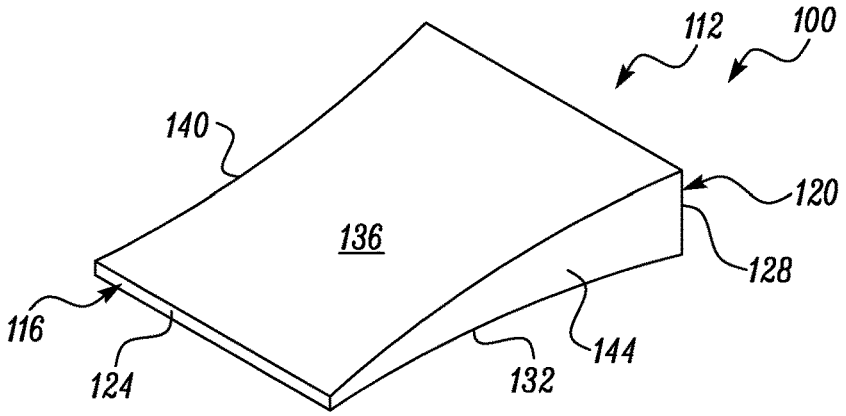
FIGS. 1A through 1E are various orthogonal views of an exemplary positioning element that is applicable alongside several positioning elements to form a stack of a feeding unit, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments.

The apparatus and method components have been represented where appropriate by conventional symbols in the drawings, showing only those specific details that are pertinent to understanding the embodiments so as not to obscure the description with details that will be readily apparent to those of ordinary skill in the art having the benefit of the description herein.

DETAILED DESCRIPTION OF THE INVENTION

The embodiments described herein are related to a feeding unit that provides support during a feeding activity (for example, an infant feeding activity), and, in particular, to an adjustable feeding unit that could be angularly adjusted to correct a position of an infant or a caregiver, during the feeding activity.

In one aspect, an adjustable feeding unit for providing support during a feeding activity is described. The adjustable feeding unit includes a stack of multiple positioning elements mounted one over the other such that the positioning elements define a base surface and an angularly raised surface disposed at an angular offset with respect to the base surface. One or more of the positioning elements are removable from the stack to adjust the angular offset between the base surface and the angularly raised surface.

Reference will now be made in detail to specific embodiments or features, examples of which are illustrated in the accompanying drawings. Generally, corresponding reference numbers may be used throughout the drawings to refer to the same or corresponding parts, e.g., 1, 1', 1", 101 and 201 could refer to one or more comparable components used in the same and/or different depicted embodiments.

Referring to FIGS. 1A through 1E, and also in conjunction with FIGS. 2A through 2D, a positioning element 100 is shown and described. The positioning element 100 is one among the several positioning elements that are mounted one over the other to form a stack 104 (see FIGS. 2A through 2D), and which are then combined and/or retained together so as to be applied as a feeding unit 108 (also see FIGS. 9A through 9C and FIG. 10). The feeding unit 108 is applied during a nursing activity or a feeding activity. In some examples, the feeding activity includes an activity, for example, a breastfeeding activity or a bottle feeding activity, associated with an infant. During a feeding activity, the feeding unit 108 can be used to provide support (for example, to the infant and/or to a caregiver). Aspects related to the manner in which the stack 104 and/or the feeding unit 108 can be applied during the feeding activity to provide support are described later. The stack 104 (and/or the feeding unit 108) can have other uses and applications as well, and those that are described here are purely exemplary.

With continued reference to FIGS. 1A through 1E, details related to the positioning element 100 is now described. The positioning element 100 includes a wedge-shaped body 112

(annotated in FIG. 1A) that defines a first end 116 and a second end 120. The second end 120 is disposed oppositely to the first end 116, as shown. The first end 116 defines a first end surface 124 (see FIG. 1B) of the wedge-shaped body 112 and the second end 120 defines a second end surface 128 (see FIG. 1C) of the wedge-shaped body 112. In some embodiments, one or both the first end surface 124 and the second end surface 128 are planar surfaces and the first end surface 124 and the second end surface 128 are parallel to each other. Alternatively, one or both the first end surface 124 and the second end surface 128 include non-planar surfaces, for example, curved surfaces or irregularly shaped surfaces. Alternatively, the first end surface 124 and the second end surface 128 are non-parallel to each other, in certain cases—for example, when the one or both the first end surface 124 and the second end surface 128 include non-planar surfaces.

The wedge-shaped body 112 (see FIG. 1A) defines an underbody surface 132 and a ramp surface 136. The term 'underbody', as used here, has been applied in concurrence with the exemplary orientation of the wedge-shaped body 112 as illustrated in FIGS. 1A, 1B, 1C, and 1E. Said term 'underbody' does not necessarily mean that the underbody surface 132 will always remain under or below the ramp surface 136 when using the stack 104 or the feeding unit 108. The ramp surface 136 is inclined at an angle (for example, a wedge angle, W) (see FIG. 1E) to the underbody surface 132. As shown through several views of the positioning element 100 in FIGS. 1A through 1E, each of the underbody surface 132 and the ramp surface 136 extends from the first end 116 (or the first end surface 124) to the second end 120 (or the second end surface 128), and as the ramp surface 136 extends from the first end 116 (or the first end surface 124) to the second end 120 (or the second end surface 128), the ramp surface 136 moves further away or is progressively distanced from the underbody surface 132.

Given the inclined or angular orientation of the ramp surface 136 with respect to the underbody surface 132, a cross-sectional area of the wedge-shaped body 112 defined at the first end 116 is smaller than a cross-sectional area of the wedge-shaped body 112 defined at the second end 120. In other words, a thickness, T1, defined between the underbody surface 132 and the ramp surface 136 at the first end 116 is smaller than a thickness, T2, defined between the underbody surface 132 and the ramp surface 136 at the second end 120. Also, an area of the first end surface 124 is smaller than an area of the second end surface 128. In some embodiments, the wedge angle, W, between the ramp surface 136 and the underbody surface 132 can take any value within a range of 5 degrees to 60 degrees. It will be appreciated that said range is provided purely for illustrative purposes and/or as an example and is not to be viewed as limiting in any way.

The wedge-shaped body 112 also defines a first lateral side surface 140 and a second lateral side surface 144. The first lateral side surface 140 and the second lateral side surface 144 are respectively defined or disposed on either lateral sides of the wedge-shaped body 112. The first lateral side surface 140 and the second lateral side surface 144 extend between the underbody surface 132 and the ramp surface 136 and also span from the first end 116 (or the first end surface 124) to the second end 120 (or the second end surface 128) of the wedge-shaped body 112. In some embodiments, a distance, D1, between the first lateral side surface 140 and the second lateral side surface 144 at the first end 116 is smaller than a distance, D2, between the first lateral side surface 140 and the second lateral side surface 144 at the second end 120 (see FIGS. 1B and/or 1D). In some embodiments, the distance, D1, and the distance, D2, are same or equal.

Figure 1B:
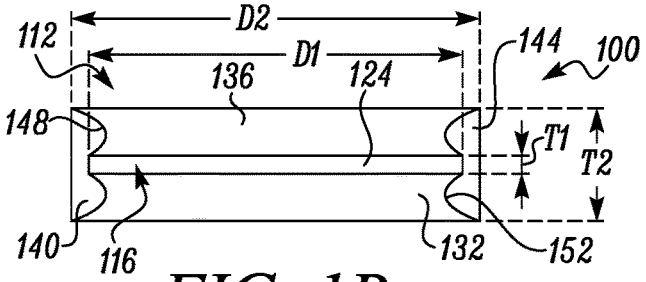
Figure 1C:
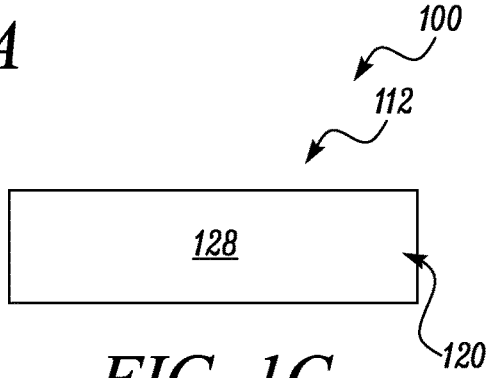
Figure 1D:
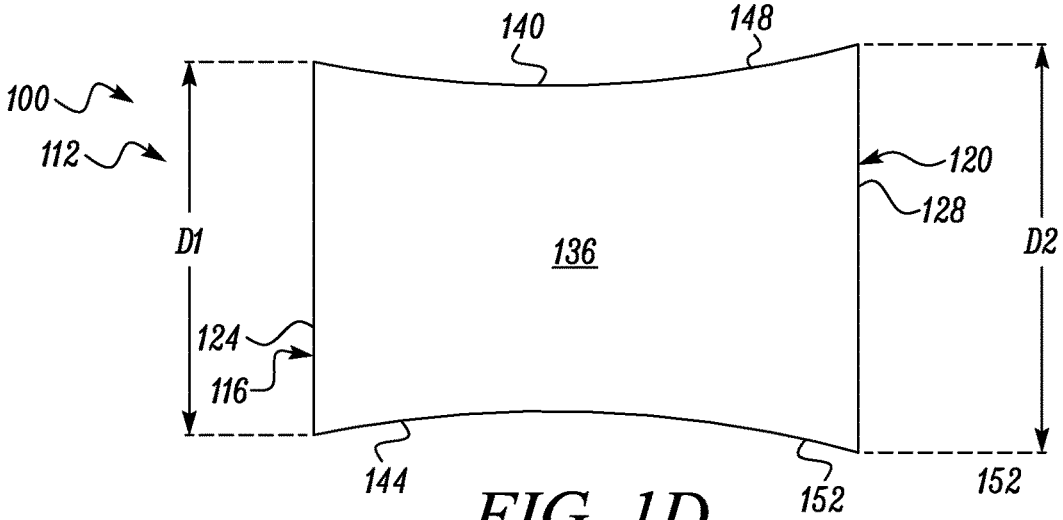
Figure 1E:
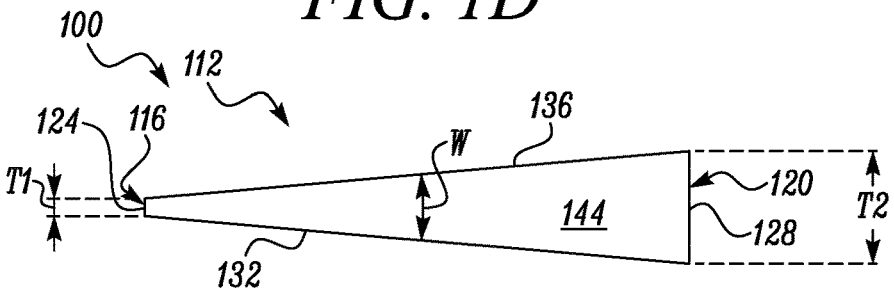

The first lateral side surface 140 defines a first concavity 148 and the second lateral side surface 144 defines a second concavity 152 (see FIGS. 1B and 1D). The first concavity 148 and the second concavity 152 correspond to respective curved profiles of the first lateral side surface 140 and the second lateral side surface 144, which is rounded inwards and directed into the wedge-shaped body 112 of the positioning element 100, as shown. As an example, each of the first concavity 148 and the second concavity 152 extend from the first end 116 to the second end 120 and, although not limited, each of the first concavity 148 and the second concavity 152 includes a profile of continuous curve, although the first concavity 148 and the second concavity 152 can include a profile of a non-continuous curve, in certain cases. In some embodiments, one or both the first concavity 148 and the second concavity 152 includes the profile of a circular arc. In some embodiments, both the first lateral side surface 140 and the second lateral side surface 144 include corrugated surfaces (not shown). Further, the positioning element 100 is formed from one or more of a general foam material, or a medical grade material, or a high density foam material, or a memory foam material, or a plastic material, or a silicone material, or an equivalent material now known or in the future developed.

In some embodiments, the positioning element 100 includes the following exemplary specifications or dimensions: the first end 116 defines a length between 4 to 16 inches and thickness between 0.25 inches to 4 inches; the second end 120 defines a length between 5 to 18 inches and thickness between 1 to 8 inches; the first lateral side surface 140 and the second lateral side surface 144 each define a length between 6 to 22 inches. The aforementioned exemplary specifications or dimensions for the positioning element 100 are provided for illustrative purposes alone and the positioning element 100 can include other values. The aforesaid values need not be viewed as limiting in any way.

Referring to FIGS. 2A through 2D, the stack 104, applicable to be used as the feeding unit 108, is described. The stack 104 includes one or more positioning elements (such as the positioning element 100) and such positioning elements are mounted one over the other so as to form the stack 104. For example, the stack 104 includes three positioning elements (for example, a first positioning element 100', a second positioning element 100", and a third positioning element 100 —) mounted one over the other, with the first positioning element 100' acquiring an uppermost position in the stack 104; the third positioning element 100'" acquiring a lowermost position in the stack 104; and the second positioning element 100" being sandwiched between the first positioning element 100' and the third positioning element 100'" in the stack 104. The number of the positioning elements, as described above for the stack 104, are provided for illustrative purposes alone, and the stack 104 can include any number of positioning elements.

Although not limited, all positioning elements 100', 100", 100'" of the stack 104 are identical (for example, in dimension and/or in profile) to each other. In this regard, each of the positioning elements 100', 100", 100'" include each of the features described for the positioning element 100. Therefore, description corresponding to the positioning element 100 are applicable to each of the first positioning element 100', the second positioning element 100", and the third positioning element 100'". Also, same or similar reference numerals, as used for describing the features of the positioning element 100, are used to describe the common features of any of the first positioning element 100', the second positioning element 100", and the third positioning element 100'". For example, the same or similar reference numerals applied for identifying common features and/or elements are used or denoted with a prime (').

In some embodiments, the stack 104 includes the positioning elements 100', 100", 100'" mounted in the same orientation. More specifically, the stack 104, as formed by exemplarily mounting the three positioning elements 100', 100", 100'" one over the other, have the first ends 116 (for example, the first end 116') of the wedge-shaped body 112 of each of the positioning elements 100', 100", 100'" (for example, the first positioning element 100') abut a first end 116 (for example, the first end 116") of a wedge-shaped body 112 of another (adjacent or adjoining) positioning element (for example, the second positioning element 100"). In so doing, the stack 104 has the first ends 116', 116", 116'" corresponding to the positioning elements 100', 100", 100'" generally face the same direction and has the second ends 120', 120", 120'" corresponding to the positioning elements 100', 100", 100'" generally face the opposite direction. The term 'generally' is used here as the second ends 120', 120", 120'", when viewed collectively, appear to turn in an angular direction (for example, see angular direction, F) (FIG. 2D), causing a (minor) variation in a direction of one second end 120 with respect to a direction of another second end 120—same can also be said about the first ends 116', 116", 116'".

In other words, the positioning elements 100', 100", 100'" of the stack 104 (as exemplarily shown in FIGS. 2A through 2D) are oriented consistently such that all first ends 116 (116', 116", 116'") are aligned together and such that all second ends 120 (120', 120", 120'") are aligned together. In so doing, the first concavity 148 corresponding to each of the positioning elements 100', 100", 100'" sits flush with one another to combinedly define a first arcuate section 156 (see FIGS. 2B and 2C) of the stack 104, and, similarly, the second concavity 152 corresponding to each the positioning elements 100', 100", 100'" sits flush with one another to combinedly define a second arcuate section 160 (see FIGS. 2B and 2C) of the stack 104. The first arcuate section 156 and the second arcuate section 160 helps the stack 104 or the feeding unit 108 suitably conform to one or more body portions of a user or a caregiver when setting the stack 104 or the feeding unit 108 close to themselves during the feeding activity.

Figure 2A:
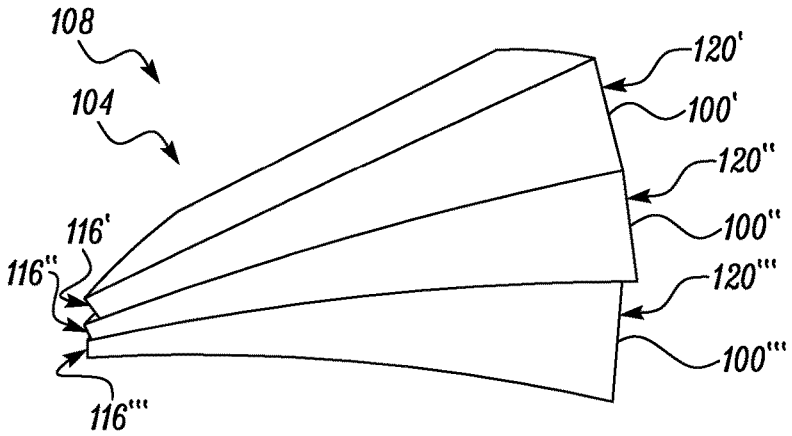
FIGS. 2A through 2D are various views of an exemplary stack of a feeding unit that includes three positioning elements mounted one over the other, in accordance with some embodiments.
Figure 2B:
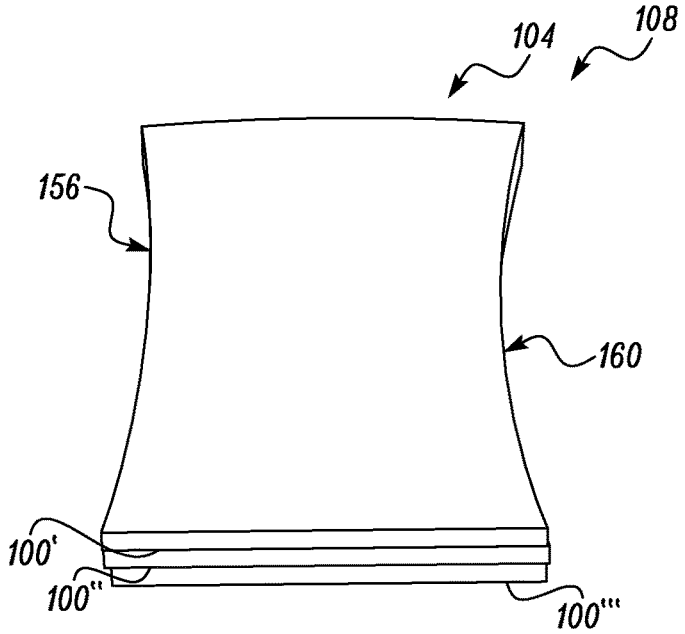
Figure 2C:
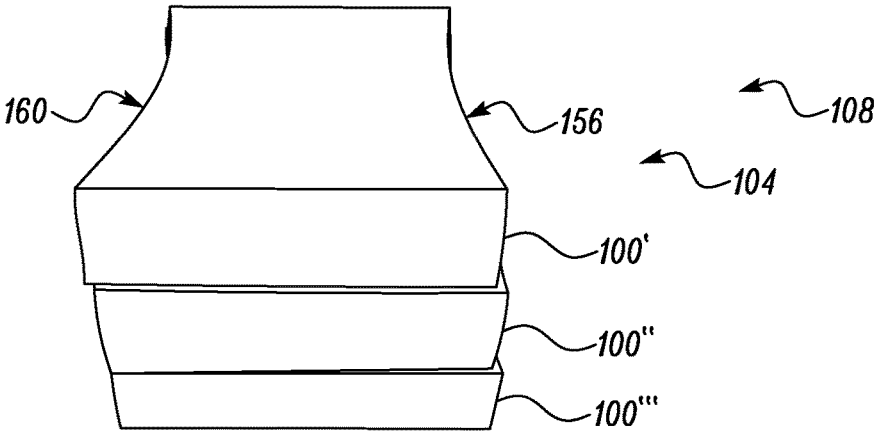
Figure 2D:
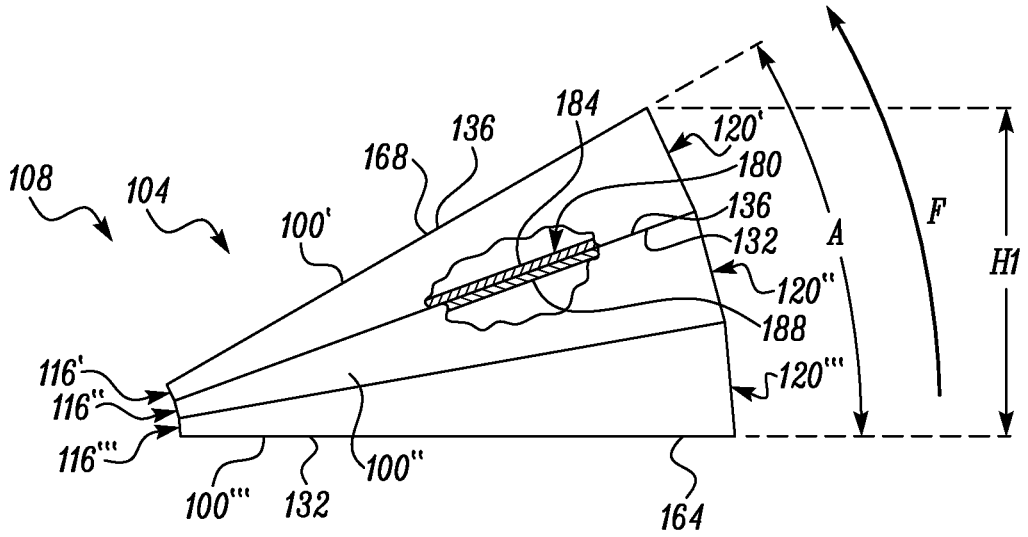

Referring to FIG. 2D, further details of the stack 104 are described. With the stack 104 including the positioning elements 100', 100", 100'" mounted one over the other and with them being oriented consistently or in the same direction, the stack 104 of the positioning elements 100', 100", 100'" defines a base surface 164 and an angularly raised surface 168 (for example, angularly raised with respect to the base surface 164). The angularly raised surface 168 is disposed at an angular offset, A, with respect to the base surface 164. The underbody surface 132 of the lowermost positioning element (for example, the third positioning element 100'") in the stack 104 defines the base surface 164, while the ramp surface 136 of the uppermost positioning element (for example, the first positioning element 100') in the stack 104 defines the angularly raised surface 168.

With continued reference to FIG. 2D, and, in some embodiments, positioning elements 100', 100", 100'" are coupled or connected in sequence so as to be arranged into the stack 104. In this regard, a connecting mechanism is applied to couple one positioning element to another (adjacent) positioning element. For example, an underbody surface 132 of a wedged-shaped body 112 of one positioning element (for example, the first positioning element 100') includes a connecting surface and the ramp surface 136 of a wedged-shaped body 112 of a successively arranged positioning element (for example, the second positioning element 100") includes a coupling surface. When mounting said positioning elements one over the other, the connecting surface is brought into contact and engagement with the coupling surface such that the two surfaces are coupled to each other and such that the two positioning elements are stacked one over the other and retained together.

As an example, for coupling one positioning element 100', 100", 100'" to another positioning element 100', 100", 100'" so as to form the stack 104, the connecting mechanism includes a Velcro mechanism 180. In this regard, an underbody surface 132 of a wedge-shaped body 112 of one positioning element (see first positioning element 100') includes a first Velcro surface 184 and the ramp surface 136 of a wedge-shaped body 112 of another (adjacent or adjoining) positioning element (for example, the second positioning element 100") includes a second Velcro surface 188. The second Velcro surface 188 is complementary to the first Velcro surface 184. To attain the coupling between one positioning element (for example, the first positioning element 100') and another positioning element (for example, the second positioning element 100"), the first Velcro surface 184 and second Velcro surface 188 are brought together to be connected to each other. In that manner, the two positioning elements 100', 100" are coupled to each other. Such connections or couplings are contemplated between other positioning elements 100', 100", 100'" of the stack 104 as well.

Additionally, or optionally, the connecting mechanism can include other means or methods of attaining the connection. As an example, the connecting mechanism, configured to couple one positioning element to another (adjacent) positioning element, can include one or more of Velcro, or magnets, or snap fittings, or double-sided tapes (not shown), which can be arranged between any two of the successively arranged positioning elements 100', 100", 100'", allowing said two successive positioning elements to be coupled and/or connected to each other.

Figure 3:
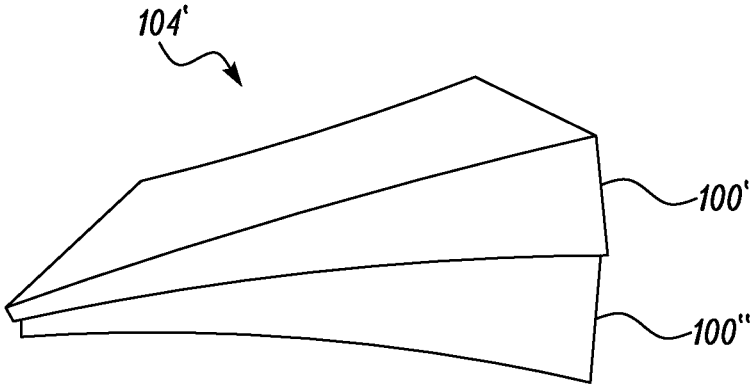
FIG. 3 is a view of an exemplary stack of a feeding unit that includes two positioning elements, in accordance with some embodiments.

The angular offset, A, of the stack 104 is adjustable by varying the number of positioning elements per stack. For example, one or more positioning elements 100', 100", 100'" can be removed from the stack 104, and/or one or more of the positioning elements (similar to positioning element 100) can be added (or returned) to the stack 104. When one or more positioning elements (for example, the third positioning element 100'") are removed from the stack 104, a stack 104' as shown in FIG. 3, is obtained. When one or more positioning elements (for example, the third positioning element 100'") are added (or returned) to the stack 104', the stack 104 is obtained. It will be appreciated that the stack 104 is also adjustable so as to include only a single positioning element (for example, the first positioning element 100') alone, and in which the second positioning element 100" and the third positioning element 100'" can be absent.

Figure 4:
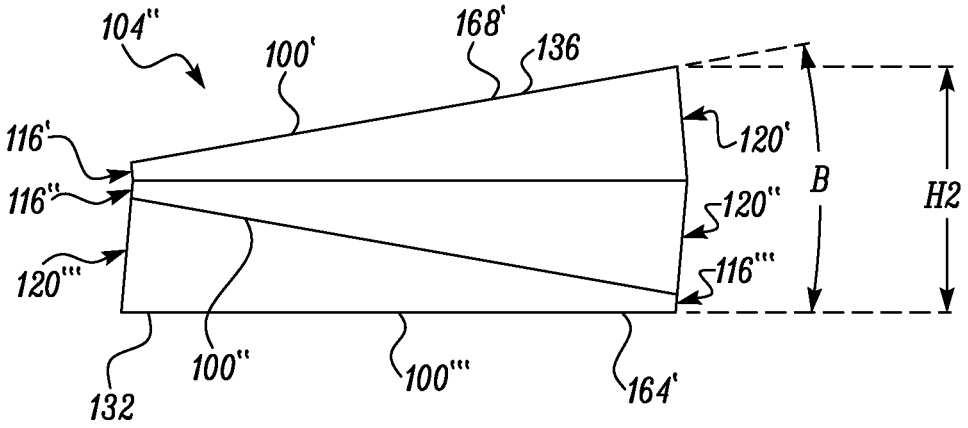
FIG. 4 is a view of an exemplary stack in which one or more positioning elements are oriented differently than one or more other positioning elements of said exemplary stack, in accordance with some embodiments.

Referring to FIG. 4, alternatively, it is possible for one or more of the positioning elements 100', 100", 100'" to be oriented in different directions or opposite directions with respect to the orientations of one or more other positioning elements 100', 100", 100'" of the stack 104. In this regard, FIG. 4 offers a view of an exemplary stack 104" in which first ends 116', 116" associated with the first positioning element 100' and the second positioning element 100" are generally facing the same direction, while the first end 116''' associated with the third positioning element 100''' is generally facing an opposite direction (for example, opposite when compared to the direction of said first ends 116', 116'' associated with the first positioning element 100' and the second positioning element 100''). In such a case, the underbody surface 132 of the lowermost positioning element (for example, the third positioning element 100''') in the stack 104'' defines a base surface 164' of the stack 104'' and the ramp surface 136 of the uppermost positioning element (for example, the first positioning element 100') of the stack 104'' defines an angularly raised surface 168' of the stack 104''. An angular offset, B, obtained between said angularly raised surface 168' and the base surface 164' of the exemplary stack 104'' is different and smaller than the angular offset, A, obtained between the angularly raised surface 168 and the base surface 164 of the stack 104 (see FIG. 2D). Also, an overall height, H2, of the exemplary stack 104'' is smaller than an overall height, H1, of the stack 104.

In some embodiments, the positioning elements 100', 100'', 100''' forming the stack 104 are non-identical or non-similar (for example, in dimension and/or in profile) to each other. As an example, the wedge angle, W, (see FIG. 1E) of one positioning element 100', 100'', 100''' of the stack 104 differs from the wedge angle, W, of another positioning element 100', 100'', 100''' of the stack 104. In yet some embodiments, each positioning element 100', 100'', 100''' of the stack 104 is similar or identical (for example, in dimension and/or in profile), but only to some, and not all, of the positioning elements 100', 100'', 100''' of the stack 104 and/or also accordingly include only some, and not all, of the features described for the positioning element 100. Many such variations can be contemplated based on the description here, but without departure from the claimed subject matter.

Figure 5A:
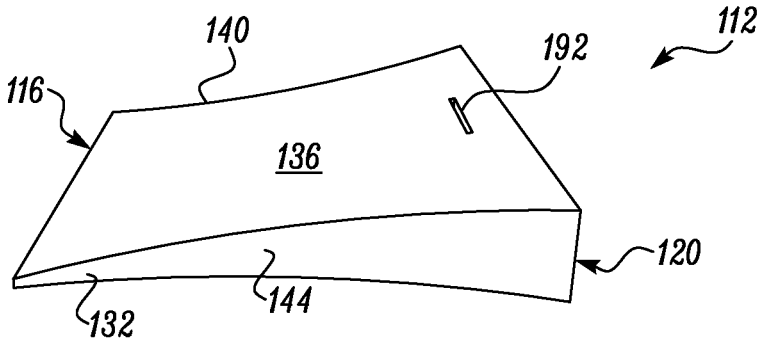
FIGS. 5A through 5C are various views illustrating an application of a closed loop flexible member that serves as a grab handle for the stack 104 of FIGS. 2A through 2D, in accordance with some embodiments.
Figure 5B:
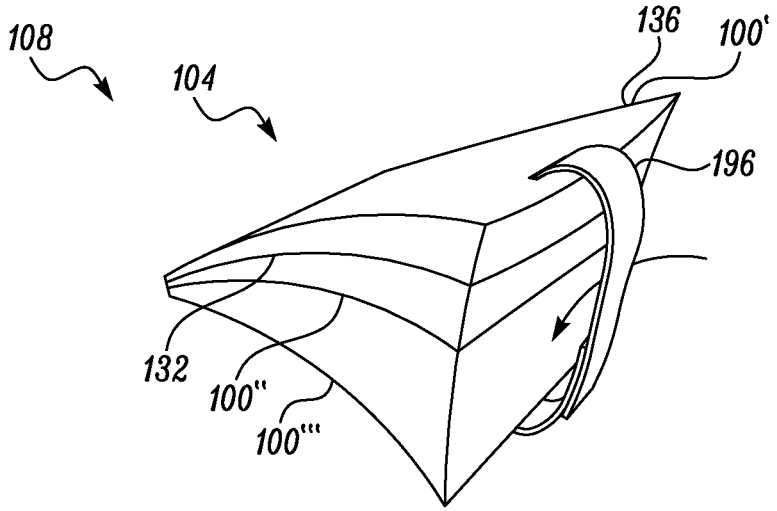
Figure 5C:
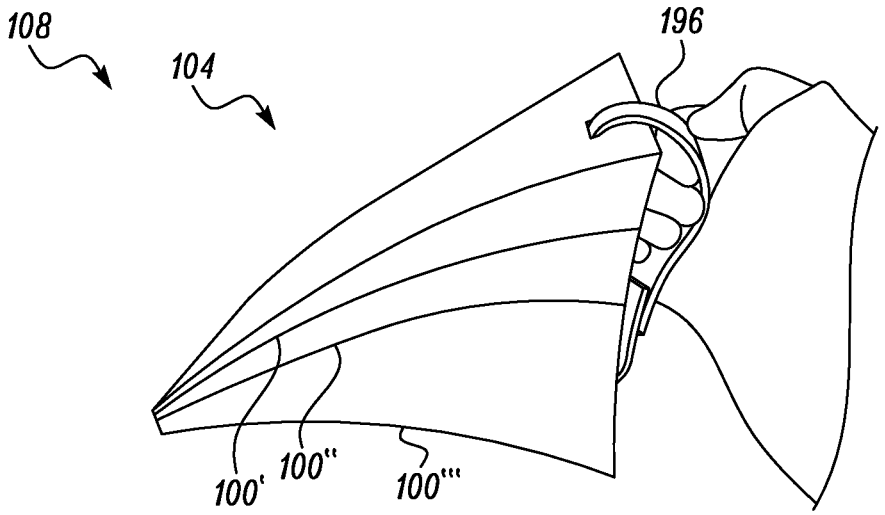

Referring to FIGS. 5A through 5C, and in some embodiments, the wedge-shaped body 112 includes one or more slits (for example, see slit 192, FIG. 5A). As an example, the slit 192 is formed at or close to the second end 120 of the wedge-shaped body 112, as shown, although it is possible for the slit 192 to be formed elsewhere on the wedge-shaped body 112—for example, the slit 192 is formed at or close to the first end 116 of the wedge-shaped body 112, or towards one of the first lateral side surface 140 or the second lateral side surface 144 of the wedge-shaped body 112. The slit 192 extends from the ramp surface 136 to the underbody surface 132. In some embodiments, slits, similar to the slit 192, are correspondingly provided for the positioning elements 100', 100'', 100''', as well, and combinedly, said slits are referred to as 'slits 192'.

When the positioning elements 100', 100'', 100''' are mounted one over the other for either attaining or adjusting the angular offset (for example, angular offset, A, between the base surface 164 and the angularly raised surface 168), the slits 192 associated with each of the positioning element 100', 100'', 100''' are aligned with each other such that a closed loop flexible member 196, which can include one or more of a piece of cloth, Velcro, silicone, elastic, plastic, fabric, rope, and/or any other flexible material, now known or in the future developed, is passed through the slits 192. To form the closed loop flexible member 196, a flexible piece or a strip of a cloth is first routed or passed through the slits 192, and then one end of the flexible piece is connected to another end of the flexible piece (by any suitable fastening or securing mechanism) such that the flexible piece defines and form the closed loop flexible member 196 (see FIGS. 5B and 5C).

When the closed loop flexible member 196 is engaged with the positioning elements 100', 100'', 100''' through the slits 192, the closed loop flexible member 196 defines a portion which is distanced from the stack 104 so as to allow a caregiver's or a user's palm or fingers to be inserted therethrough, permitting the closed loop flexible member 196 to be held or grabbed by the caregiver or the user (see FIG. 5C). Such a feature allows the closed loop flexible member 196 to serve as a grab handle for the stack 104 or the feeding unit 108. In that manner, the closed loop flexible member 196 is applied in conjunction with the stack 104 and/or is made part of the stack 104 or the feeding unit 108.

In some embodiments, the slits 192 need not be aligned to allow for varying the angular offset, A, (see FIG. 2D) and formation of the overall stack 104. In some embodiments, each positioning element 100', 100'', 100''' has multiple slits so that the stack 104 can be aligned differently by passing the closed loop flexible member 196 in different formations so as to attain a different stack formation (for example, the formation of the stack 104'' in FIG. 4). Although not limited, the slits 192 can be in the form of a hole to allow a complementarily shaped closed loop flexible member (for example, one that resembles a shoelace) to pass through.

Figure 6A:
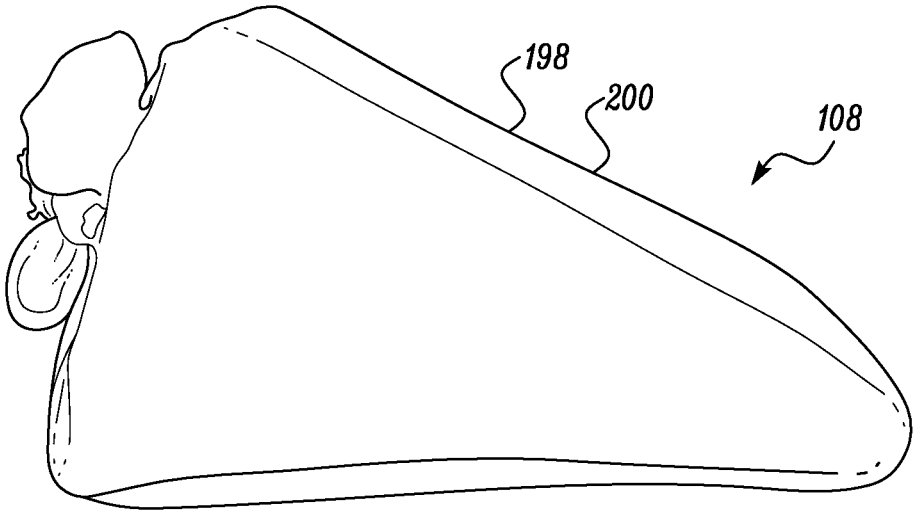
FIGS. 6A and 6B are views illustrating a flexible sheet or a pliant sheet or a cover covering the stack of FIGS. 2A through 2D, in accordance with some embodiments.
Figure 6B:
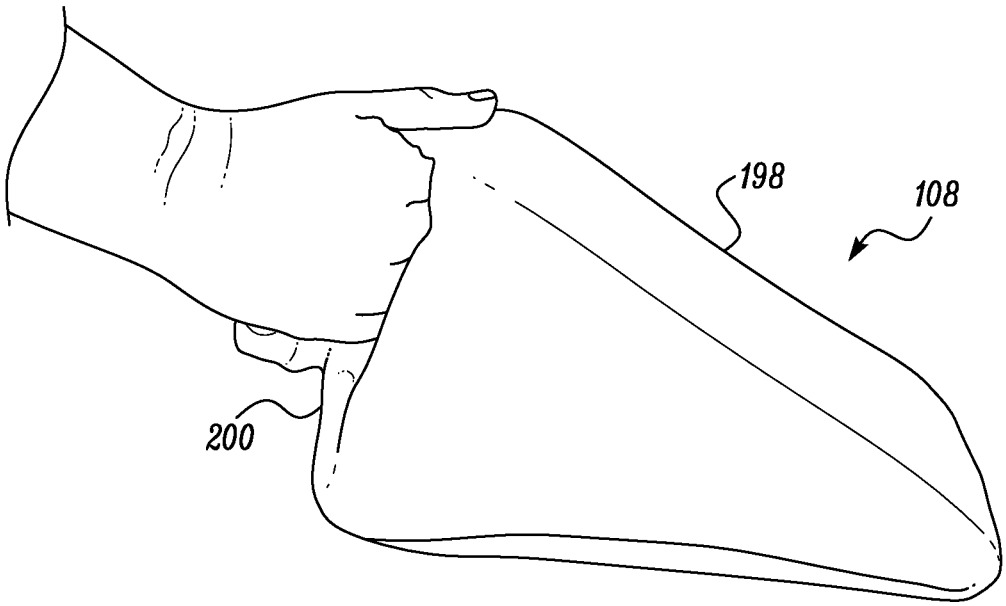

Referring to FIGS. 6A and 6B, the feeding unit 108 includes a cover or a flexible sheet or a pliant sheet 198, for example, in the form of a cloth 200 or other similar materials, now known or in the future developed (for example, a flexible cover or a flexible cloth piece) to enclose the stack 104. For example, the cloth 200 covers the stack 104 and retains the stack 104 as a single unit. The cloth 200 is made from any suitable material which is easily wrapped and wound around the stack 104 and which is then turned and tied into itself such that the cloth 200 is fully or at least partially enclosing the stack 104 therein. The cloth 200 is also washable. In some embodiments, one or more extensions (not shown) of the cloth 200 are wound around the stack 104 and tied together such that the extensions, in concert, serve as a grab handle for the stack 104 or for the feeding unit 108. In such a case, the closed loop flexible member 196 can be omitted from the feeding unit 108. In some embodiments, the cloth 200 includes a separate or an independent handle (not shown) that can be made from the same material as the cloth 200 or a material which is different from the material of the cloth 200 now known or in the future developed.

Figure 7A:
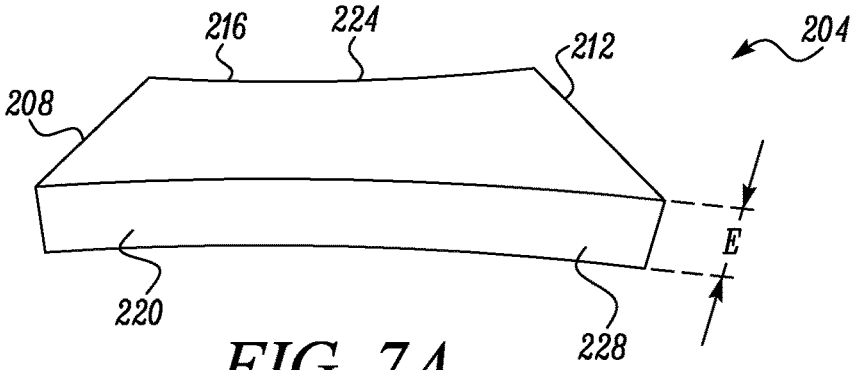
FIGS. 7A through 7C are various views illustrating an exemplary elevating element and its application, in accordance with some embodiments.
Figure 7B:
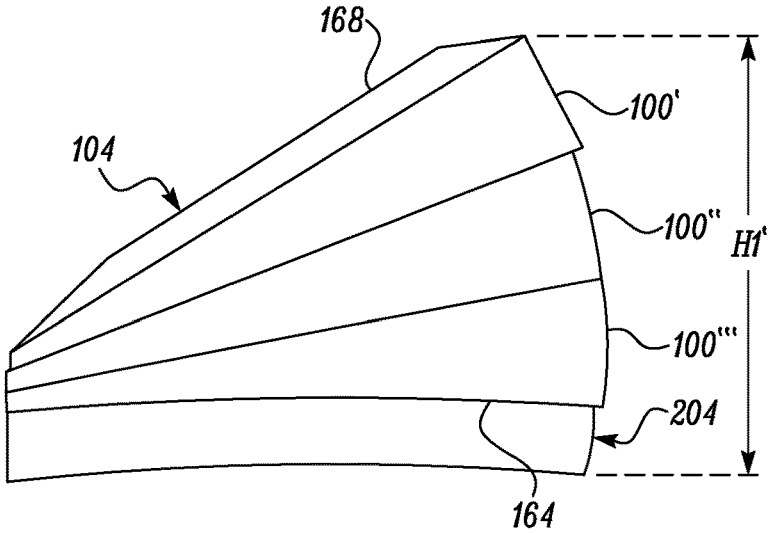
Figure 7C:
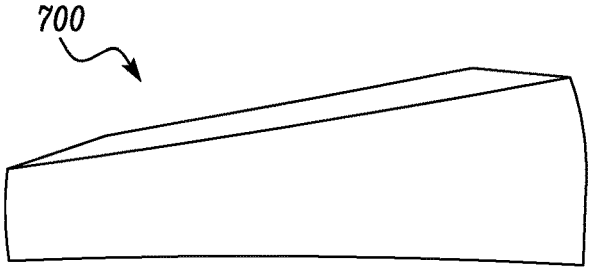

Referring to FIGS. 7A through 7C, the feeding unit 108 include one or more elevating elements (see an elevating element 204). The elevating element 204 is used to elevate or raise the stack 104. The elevating element 204 includes a planarly laid out body defining a thickness, E. Although not limited, the thickness, E, is constant throughout an extension (for example, a planar extension) of the elevating element 204. The elevating element 204 includes a first end portion 208 and a second end portion 212 and further includes a first lateral side portion 216 and a second lateral side portion 220 extending between the first end portion 208 and the second end portion 212. The first lateral side portion 216 and the second lateral side portion 220, in some embodiments, respectively define a first curved contour 224 and a second curved contour 228 of the elevating element 204. Further, the elevating element 204, in some embodiments, is made from the same material as one or more of the positioning elements 100', 100'', 100''', and thus includes one or more of a general foam material, or a medical grade material, or a high density foam material, or a memory foam material, or a plastic material, or a silicone material, or an equivalent material now known or in the future developed.

In an assembly of the elevating element 204 with the stack 104, the elevating element 204 is positioned under and/or is brought into contact with the base surface 164 of the stack 104 such that the elevating element 204 is placed beneath or under the stack 104. In so doing, the elevating element 204 elevates or raises an overall height (for example, height, H1) of the stack 104 by a value that equals or corresponds to the thickness, E, of the elevating element 204 (see height, H1', FIG. 7B). Further, when the elevating element 204 is placed under the stack 104, the first curved contour 224 of the first lateral side portion 216 is aligned with the first arcuate section 156 of the stack 104 and the second curved contour 228 of the second lateral side portion 220 is aligned with the second arcuate section 160 of the stack 104. A connection of the elevating element 204 with the base surface 164 of the stack 104 can be attained by using a connecting mechanism, which can be similar to the connecting mechanism discussed in connection with FIG. 2D.

Effectively, adding or removing one or more of the positioning elements 100', 100", 100'" changes the angle (or the angular offset, A) of the stack 104 (or the feeding unit 108) and removing or adding the elevating element 204 changes the height (for example, height, H1) of the stack 104 (or the feeding unit 108). It will be appreciated that the stack 104 or the feeding unit 108 can include more than one elevating element.

In some embodiments, the elevating element 204 is integrally formed with one of the positioning elements 100', 100", 100'". For example, the elevating element 204 is integrally formed with the third positioning element 100'" of the stack 104 to define a positioning element 700 (see FIG. 7C). In such a case, the assembly and connection between the elevating element 204 and the base surface 164 of the stack 104, as described above, is not needed.

Figure 8A:
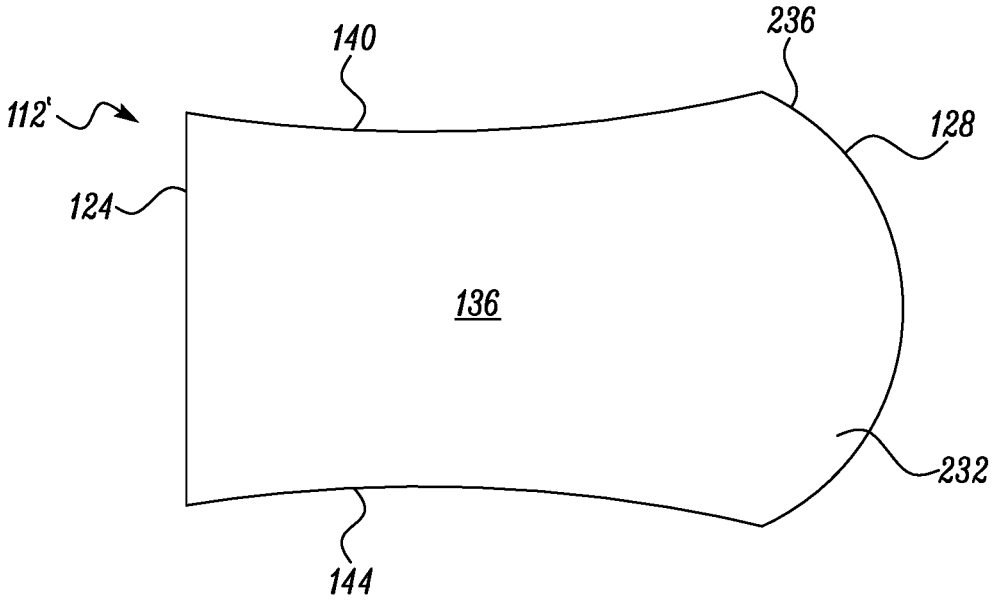
FIGS. 8A and 8B are views that illustrate alternative configurations or profiles of the positioning element of FIGS. 1A to 1E, in accordance with some embodiments.

Referring to FIG. 8A, a wedge-shaped body 112' is shown. The wedge-shaped body 112' is usable as a positioning element in the stack 104. The wedge-shaped body 112' includes one or more of the features of the wedge-shaped body 112 and thus includes common reference numerals as the wedge-shaped body 112 for reference to common parts and/or features, with the exception that the second end surface 128 of the wedge-shaped body 112' includes a bulged surface 232. The bulged surface 232 defines a convexity 236 or defines a profile that extends outwards of the wedge-shaped body 112, as shown. The bulged surface 232 extends in and along the same plane along which the ramp surface 136 extends. Further, the convexity 236 extends or is defined from the first lateral side surface 140 to the second lateral side surface 144, or, in some cases, the bulged surface 232 is defined in a manner in which it is spaced away from each of the first lateral side surface 140 and the second lateral side surface 144. The bulged surface 232 can be used to rest an infant's head during the feeding activity.

Figure 8B:
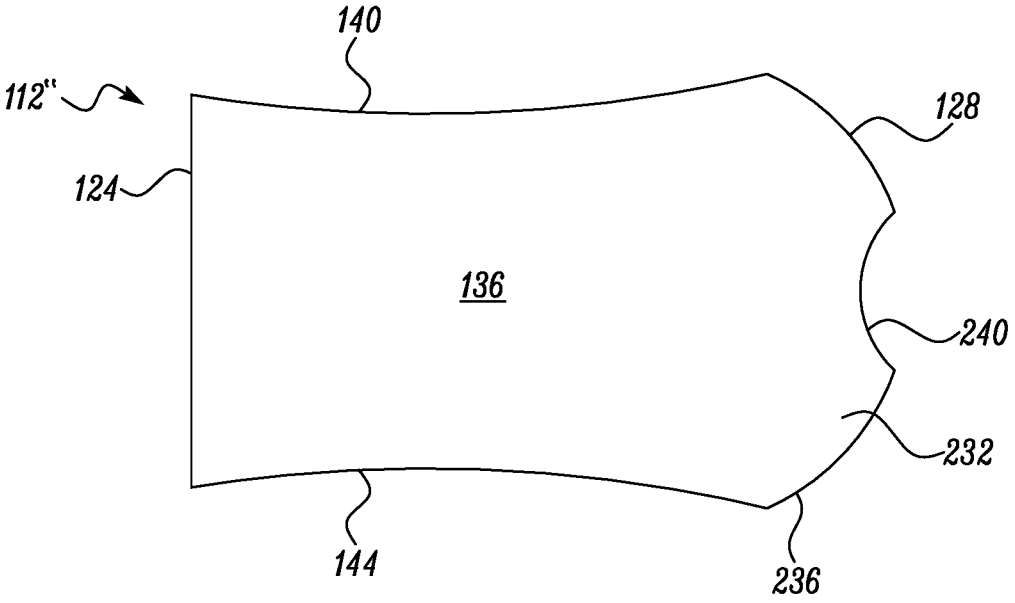

With reference to FIG. 8B, a wedge-shaped body 112" is shown. The wedge-shaped body 112" is usable as a positioning element in the stack 104. The wedge-shaped body 112" includes one or more of the features of the wedge-shaped body 112' and thus includes common reference numerals as the wedge-shaped body 112' for reference to common parts and/or features, with the exception that the bulged surface 232 of the wedge-shaped body 112" at the second end surface 128 defines a notch or a cutout 240. The cutout 240 can be used to route the user's or the caregiver's palm or fingers through the closed loop flexible member 196 when the stack 104 or the feeding unit 108 is held by use of the closed loop flexible member 196 (see FIGS. 5A through 5C). In some embodiments, the cutout 240 is formed at an apex of the convexity 236, although the cutout 240 can be formed elsewhere on the wedge-shaped body 112 depending upon a position of the closed loop flexible member 196.

Figure 9C:
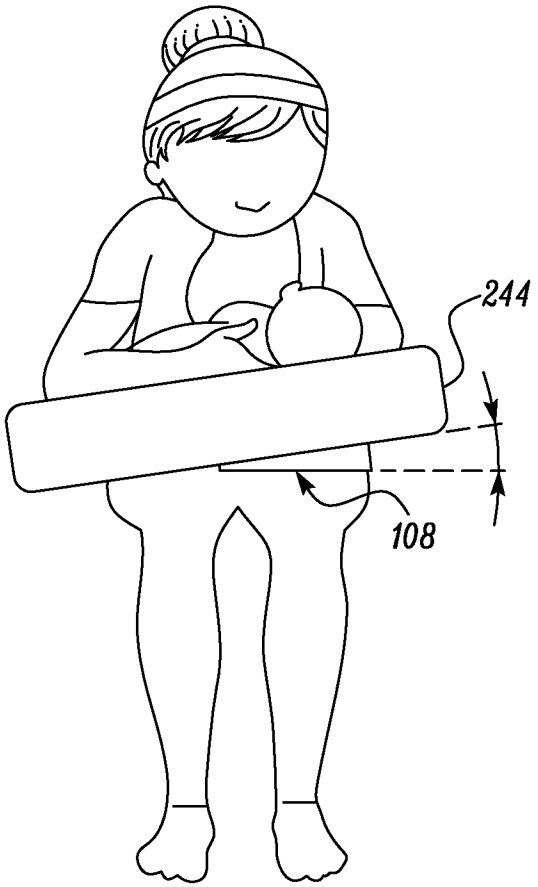
FIGS. 9A through 9L are various views illustrating exemplary applications of various embodiments of the feeding unit, in accordance with some embodiments.
Figure 9B:
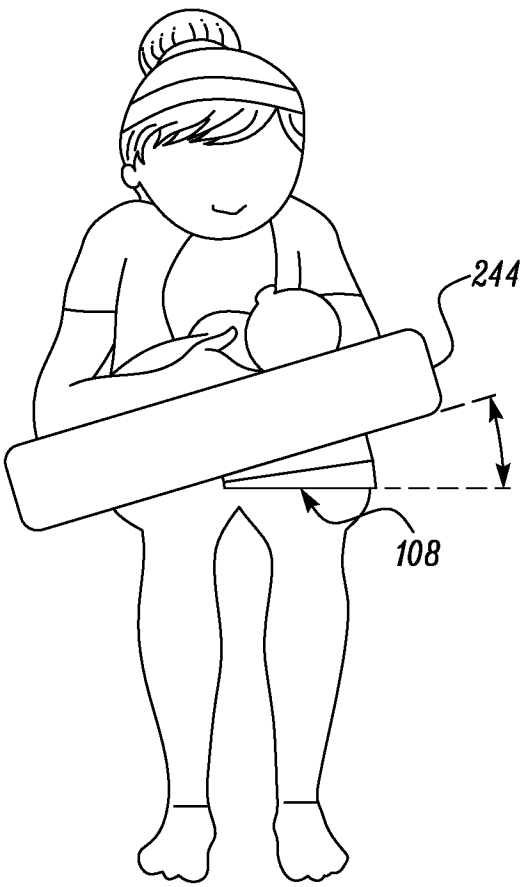
Figure 9A:
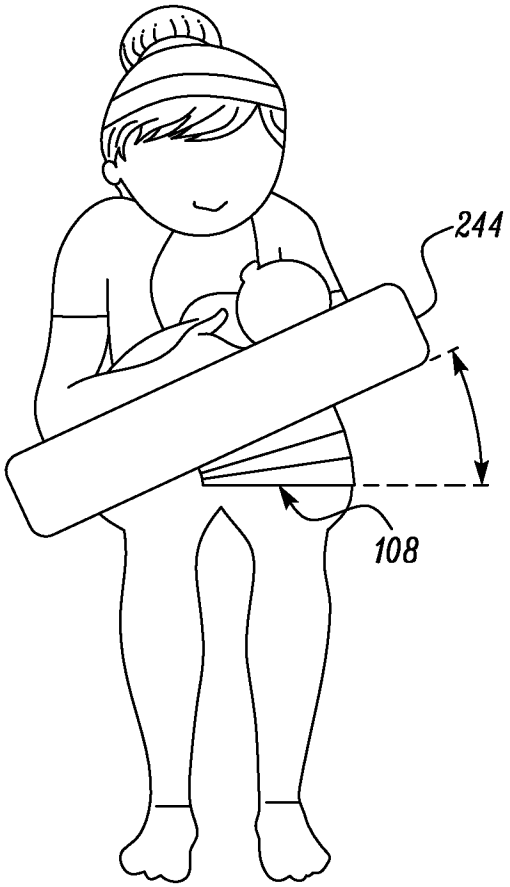
Figure 9D:
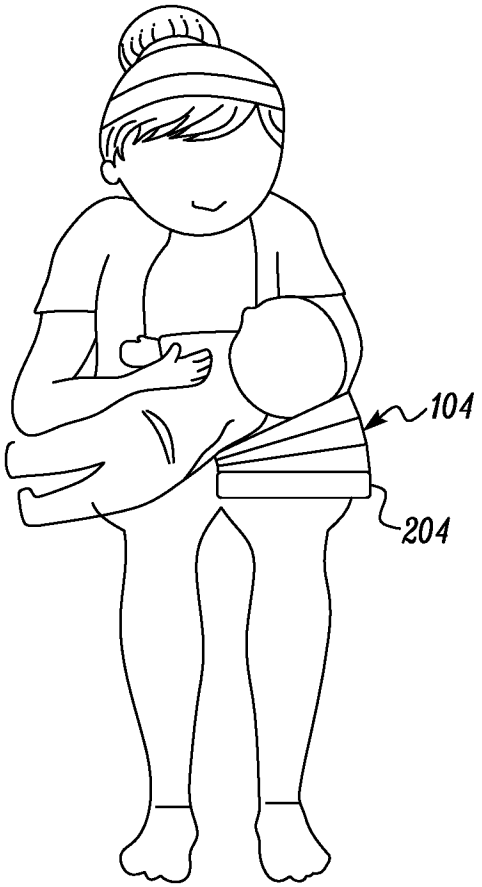
Figure 9E:
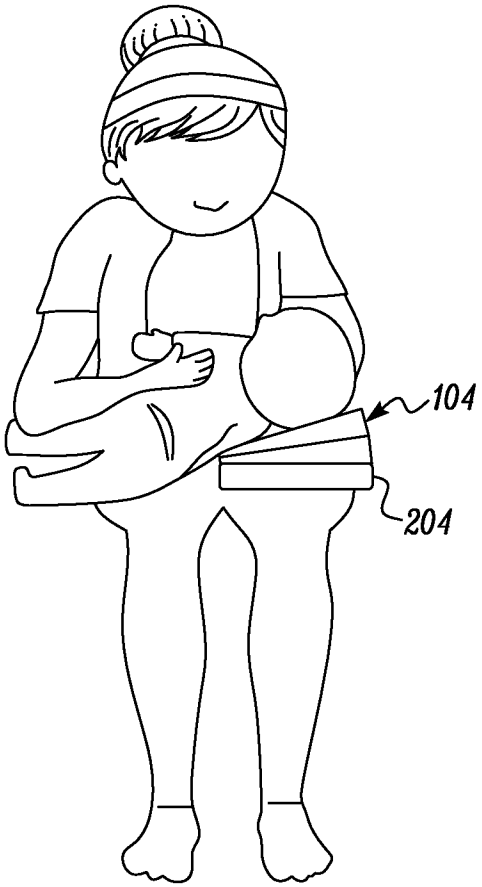
Figure 9F:
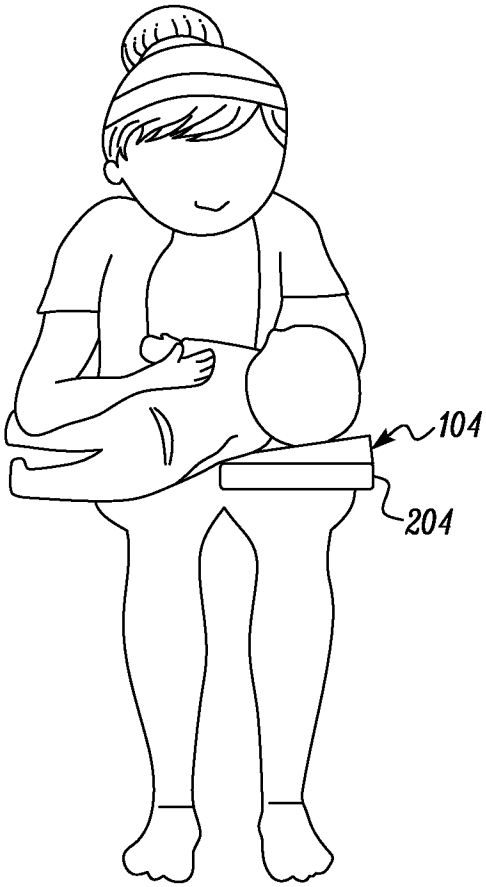
Figure 9I:
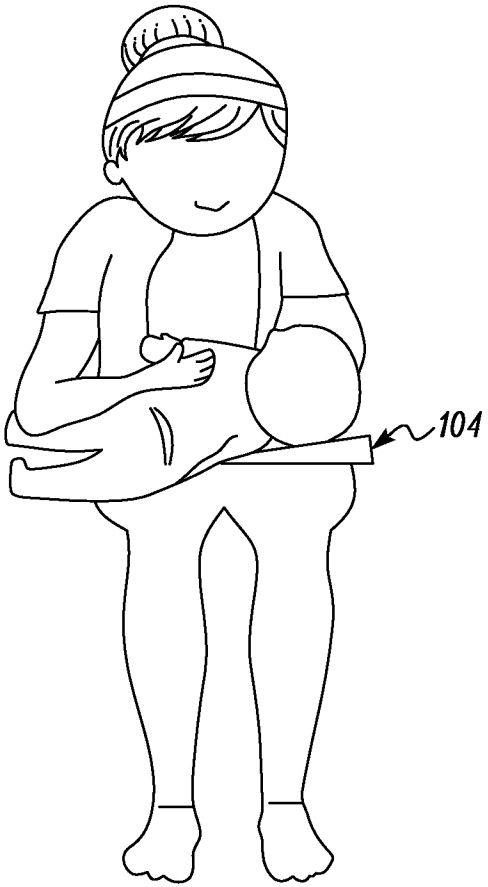
Figure 9H:
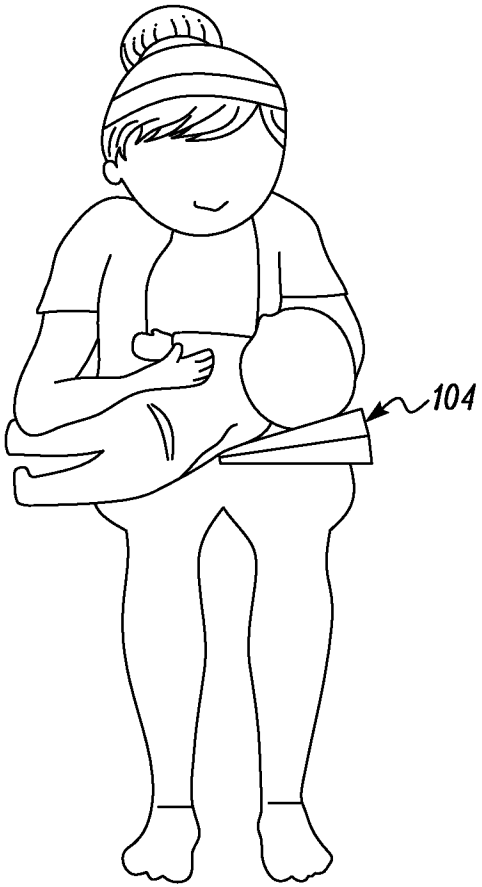
Figure 9G:
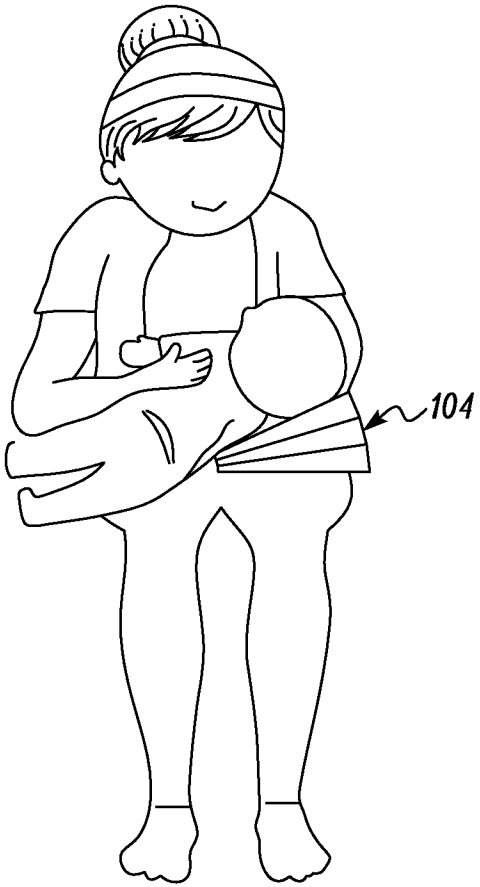
Figure 9L:
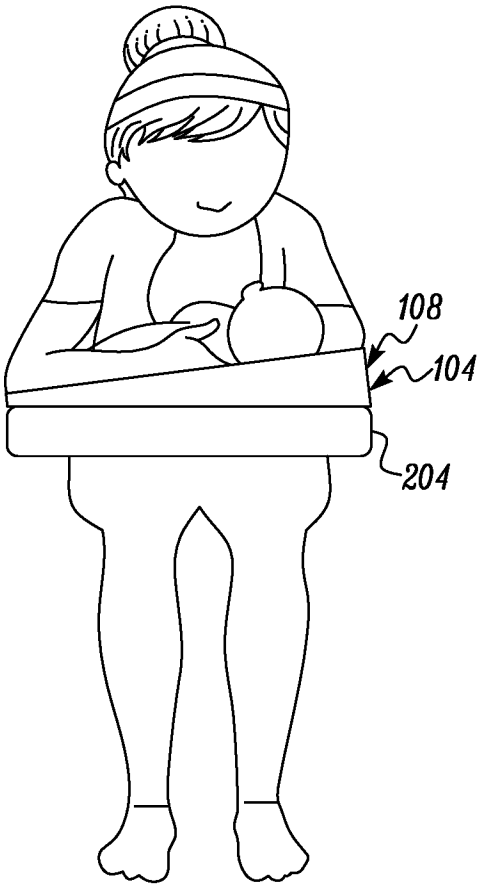
Figure 9K:
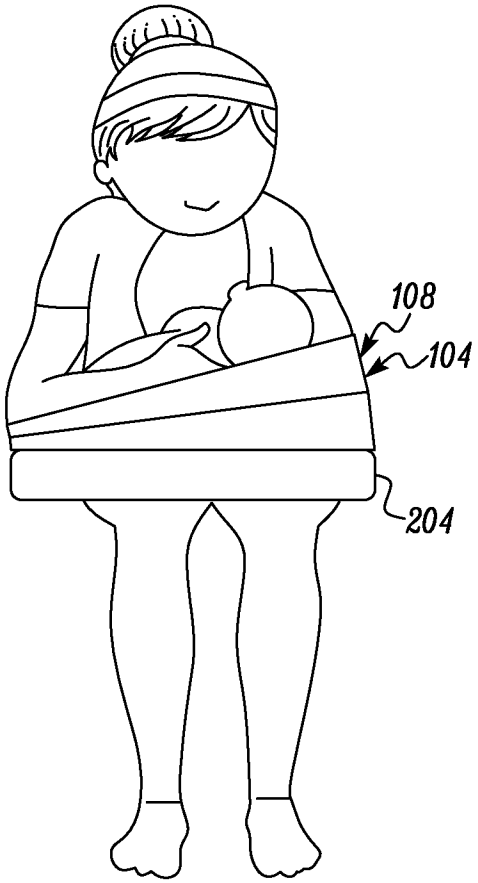
Figure 9J:
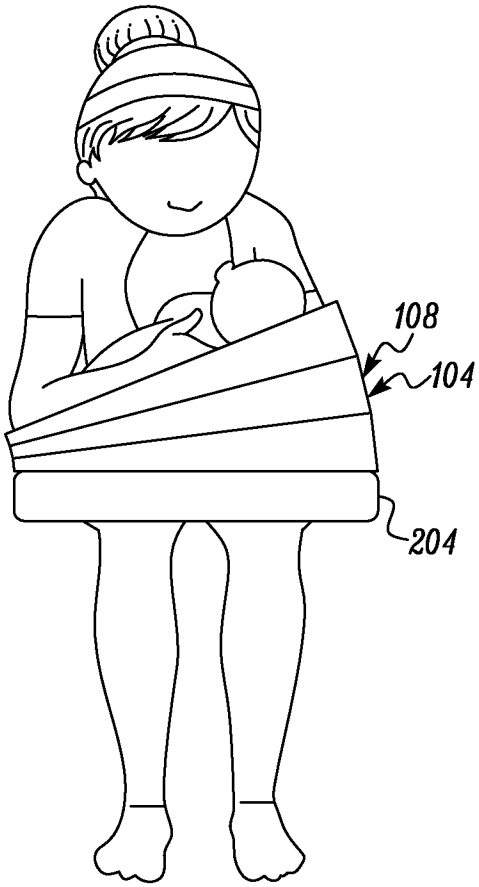
Figure 10:
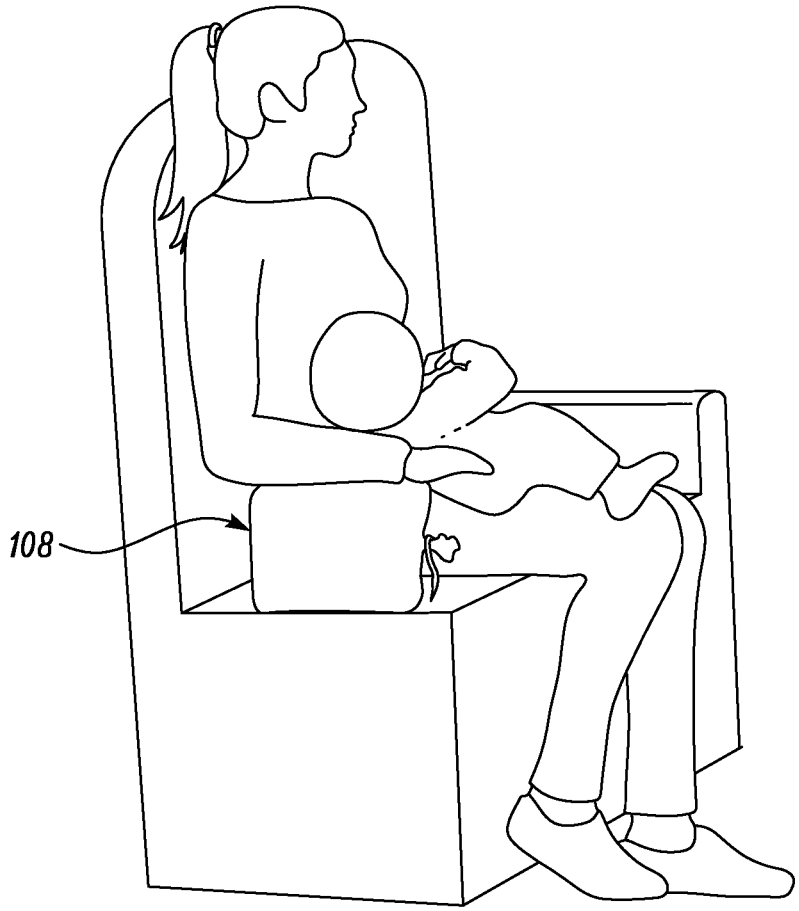
FIG. 10 is a view illustrating another exemplary application of the feeding unit, in accordance with some embodiments.

Referring to FIGS. 9A through 10, the stack 104 or the feeding unit 108 is applied to support an infant and/or to a caregiver attending to the infant so as to feed the infant during a feeding activity or a nursing activity. The feeding activity or nursing activity can correspond to a breastfeeding activity or a bottle feeding activity, and the stack 104 or the feeding unit 108 is applied to elevate and/or support and/or correct a position of the infant's head, during the feeding activity or the nursing activity, as shown in FIGS. 9A through 10.

With regard to FIGS. 9A through 9C, an application of the stack 104 or the feeding unit 108 with a pillow 244 (for example, a breastfeeding pillow useable for a breastfeeding activity) is illustrated and described hereinbelow. It will be noted that any reference to a 'breastfeeding pillow' can include or correspond to any pillow which may be usable for breastfeeding. The application illustrated in FIGS. 9A through 9C is referred to as a first application. The first application also illustrates the adjustable nature of the stack 104 or the feeding unit 108. More particularly, the adjustable nature of the stack 104 or the feeding unit 108 facilitates or enables the angular offset (for example, angular offset, A) of the stack 104 or the feeding unit 108 to be varied, allowing the caregiver to customize, adjust, and/or correct the feeding angle of the infant, depending upon a size, a body type, or a position of the caregiver or the infant. In so doing, the infant's head is optimally and appropriately raised or elevated above its stomach, allowing the infant to feed at or close to the optimal feeding angle. Effectively, it will be noted that the stack 104 can be configured to elevate and correct a position of the pillow 244 when supporting an infant on the pillow 244 during the breastfeeding activity. In some embodiments, the stack 104 and the pillow 244 can be part of the feeding unit 108. Also, the pillow 244 and the stack 104 can be coupled together by way of a mechanism, such as the Velcro mechanism 180. The pillow 244 and the stack 104 can also be coupled and stacked together by way of any outer cover (not shown) encompassing both.

FIG. 9A illustrates the use of three positioning elements (for example, the first positioning element 100', the second positioning element 100", and the third positioning element 100'") in conjunction with the pillow 244 to elevate the infant's head to bring the infant at or close to the optimal feeding angle; FIG. 9B illustrates the use of two positioning elements (for example, the first positioning element 100' and the second positioning element 100") in conjunction with the pillow 244 to elevate the infant's head to bring the infant at or close to the optimal feeding angle; and FIG. 9C illustrates the use of a single positioning element (for example, the first positioning element 100') in conjunction with the pillow 244 to elevate the infant's head to bring the infant at or close to the optimal feeding angle.

Further, FIGS. 9D through 9F illustrate another exemplary application of the stack 104 or the feeding unit 108, and said application can be referred to as a second application. The second application corresponds to supporting an infant and/or to a caregiver attending to the infant in the same manner as has been described for FIGS. 9A through 9C so as to feed the infant during the feeding activity or the nursing activity, with the exception that said second application omits the use of the pillow 244, during the feeding activity or the nursing activity. Instead, the second application includes the use of the elevating element 204 with the stack 104. In such a case, the stack 104 and the elevating element 204 can be part of the feeding unit 108.

FIGS. 9G through 9I illustrates yet another exemplary application of the stack 104 or the feeding unit 108, and said application can be referred to as a third application. The third application corresponds to supporting an infant and/or to a caregiver attending to the infant in the same manner as has been described for FIGS. 9A through 9C so as to feed the infant during the feeding activity or the nursing activity, with the exception that said third application omits the use of the both the pillow 244 and the elevating element 204.

Furthermore, FIGS. 9J through 9L illustrates still another exemplary application of the stack 104 or the feeding unit 108, and said application can be referred to as a fourth application. The fourth application corresponds to supporting an infant and/or to a caregiver attending to the infant in the same manner as has been described for FIGS. 9A through 9C so as to feed the infant during the feeding activity or the nursing activity, with the exception that said fourth application utilizes a relatively large sized stack 104 and elevating element 204 compared to the sizes of the stack 104 and the elevating element 204 in FIGS. 9A through 9I, during the feeding activity or the nursing activity.

The sizes in any of the aforesaid applications described in conjunction with FIGS. 9A through 9L are not to be viewed as limiting in any way. Further, in any of the applications provided in FIGS. 9A through 9L, a positioning element similar to the positioning element 700 (see FIG. 7C) can be used either additionally or optionally to any of the one or more of the positioning elements 100 and/or the elevating element 204 employed in the stack 104 or in the feeding unit 108. By use of the feeding unit 108, in one or more of the ways described above, digestive difficulties in an infant are eased and/or the incidence of digestive difficulties in an infant are decreased. Because of the adjustable nature of the feeding unit 108, the term feeding unit 108, as used herein, is also be referred to as an 'adjustable feeding unit 108'. As will be appreciated, the term 'adjustable' means that one or more positioning elements 100', 100", 100'" in the feeding unit 108 is removable or returnable to the stack 104 such that one or more parameters (for example, the angular offset, A) of the feeding unit 108 can be varied and/or adjusted. The term 'adjustable' also means that by the use of the elevating element 204, an overall height of the stack 104 is adjusted or increased.

Further, it will be appreciated that, in some cases, the feeding unit 108 itself is sized appropriately such that the feeding unit 108 can act as a pillow for breastfeeding (see FIGS. 9J through 9L). As an example, a larger sized breastfeeding pillow can commensurately require a larger sized feeding unit, and, conversely, a smaller sized breastfeeding pillow can commensurately require a smaller sized feeding unit. The sizes of the feeding unit 108 and the pillow 244 are not drawn to scale in FIG. 9 (or in any figure), and they are not to be viewed as limiting in any way, as they are illustrated to provide an example application of the feeding unit 108 among several example applications of the feeding unit 108. It will be appreciated that the stack 104 or the feeding unit 108 in FIGS. 9J through 9L can be used without the elevating element 204, as well.

Referring to FIG. 10, the stack 104 (or the feeding unit 108) can also offer support and/or elevation to a caregiver (for example, the caregiver's arm, elbow, hand, and/or wrist) when the stack 104 (or the feeding unit 108) is turned and placed on one of its lateral sides. For example, the stack 104 (or the feeding unit 108) is seated atop a bench, a surface, or a chair (for example, a nursery chair), on which the caregiver is seated and have one of the first arcuate section 156 or the second arcuate section 160 face downwards and the other of the first arcuate section 156 or the second arcuate section 160 face upwards, such that the caregiver is able to rest a portion of its hands over the upward facing arcuate section. Such use of the stack 104 (or the feeding unit 108) is contemplated when the infant's head is needed to be rested atop the caregiver's hand, wrist, or arm, and the caregiver's hand, wrist, or arm, needs support.

The application of the stack 104 or the feeding unit 108, as shown in FIG. is not only used to attain the optimal feeding angle and prevent digestive difficulties in the infant, but it is also used for the convenience of the caregiver and to prevent the inducement of strain and fatigue in the caregiver arm, elbow, or wrist. In some embodiments, the stack 104 or the feeding unit 108 is angled, turned, or rotated, to support a variety of other nursing or feeding positions, including, but not limited to, reclined nursing position, football hold position, cross cradle position, side lying position. In some embodiments, the exemplary stack 104" of FIG. 4 is used for the application described in connection with FIG. 10, as the exemplary stack 104" defines a relatively increased surface area at each of its first arcuate section 156 and the second arcuate section 160, allowing the caregiver's hand to be conveniently rested atop one of them.

In some embodiments, the stack 104 (for example, the wedge-shaped body 112) or the pliant sheet 198 is provided with a layer (for example, a relatively thin layer) of a hydrophobic or a water repellant coating, for example, acrylic coatings, epoxy coating, that opposes any liquid, such as water, from adhering against the outer surfaces of the stack 104 or prevents an ingress of any liquid, such as water, into a body (for example, the wedge-shaped body 112) of the stack 104. Such coatings allow any liquid deposit on the surfaces of the stack 104 to be relatively easily wiped away from the stack 104, thus simplifying use particularly when infants or new-born need to be nursed in medical or neonatal care sections of hospitals.

Figure 11A:
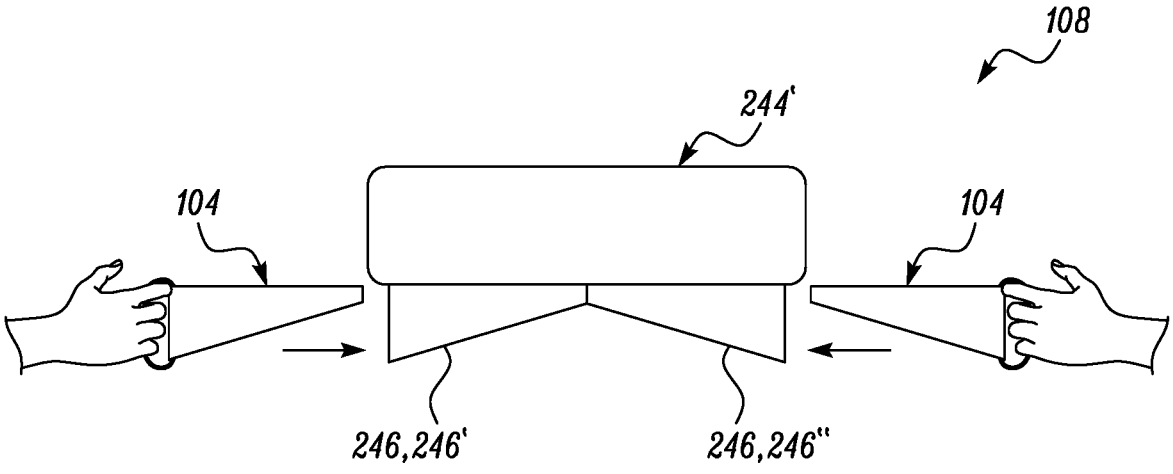
FIGS. 11A through 12 illustrate yet other exemplary applications of the stack or the feeding unit, in accordance with some embodiments.

Referring to FIG. 11A, a pillow 244' is discussed. The pillow 244' may be same as the pillow 244, but can include one or more pockets 246 to correspondingly receive and accommodate one or more stacks 104. As an example, the application illustrated in FIG. 11A includes the pillow 244' having two pockets 246 (for example, a first pocket 246' and a second pocket 246") for correspondingly receiving and accommodating the stack 104 one at a time. As an exemplary application, with a single stack 104, during a breastfeeding activity or a nursing activity, a caregiver can insert the stack 104 into the first pocket 246', to lift and feed the infant from a first side, and then remove the stack 104 to insert the stack 104 in the second pocket 246" to lift and feed the infant from the second side. In some embodiments, the pockets 246 can be provided on a cover for the pillow 244.

Figure 11B:
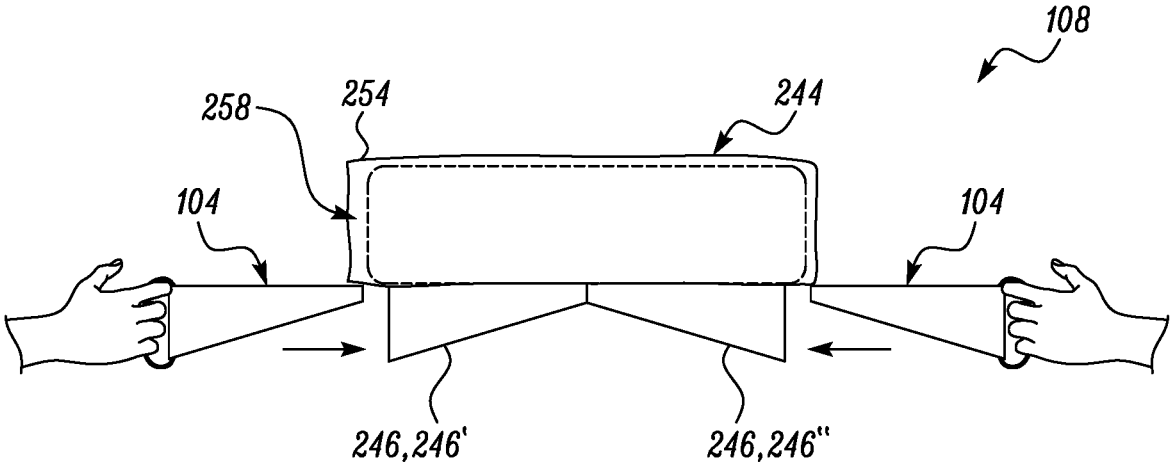

Referring to FIG. 11B, the same application as the application described in connection with FIG. 11A can be achieved by having the pockets 246 (for example, the first pocket 246' and the second pocket 246") formed in a sheath 254 instead of having the pockets 246 (for example, the first pocket 246' and the second pocket 246") formed in the pillow 244 (or in a cover for the pillow 244). In such a case, the sheath 254, in addition to defining the first pocket 246' and the second pocket 246", can also define a pillow pocket 258 which can receive and accommodate the pillow 244 therein. In so doing, the stack 104 is configured to elevate and correct a position of the pillow 244 received within the sheath 254. Also, in such a case, the stack 104 and sheath 254 can be part of the feeding unit 108.

Figure 12:
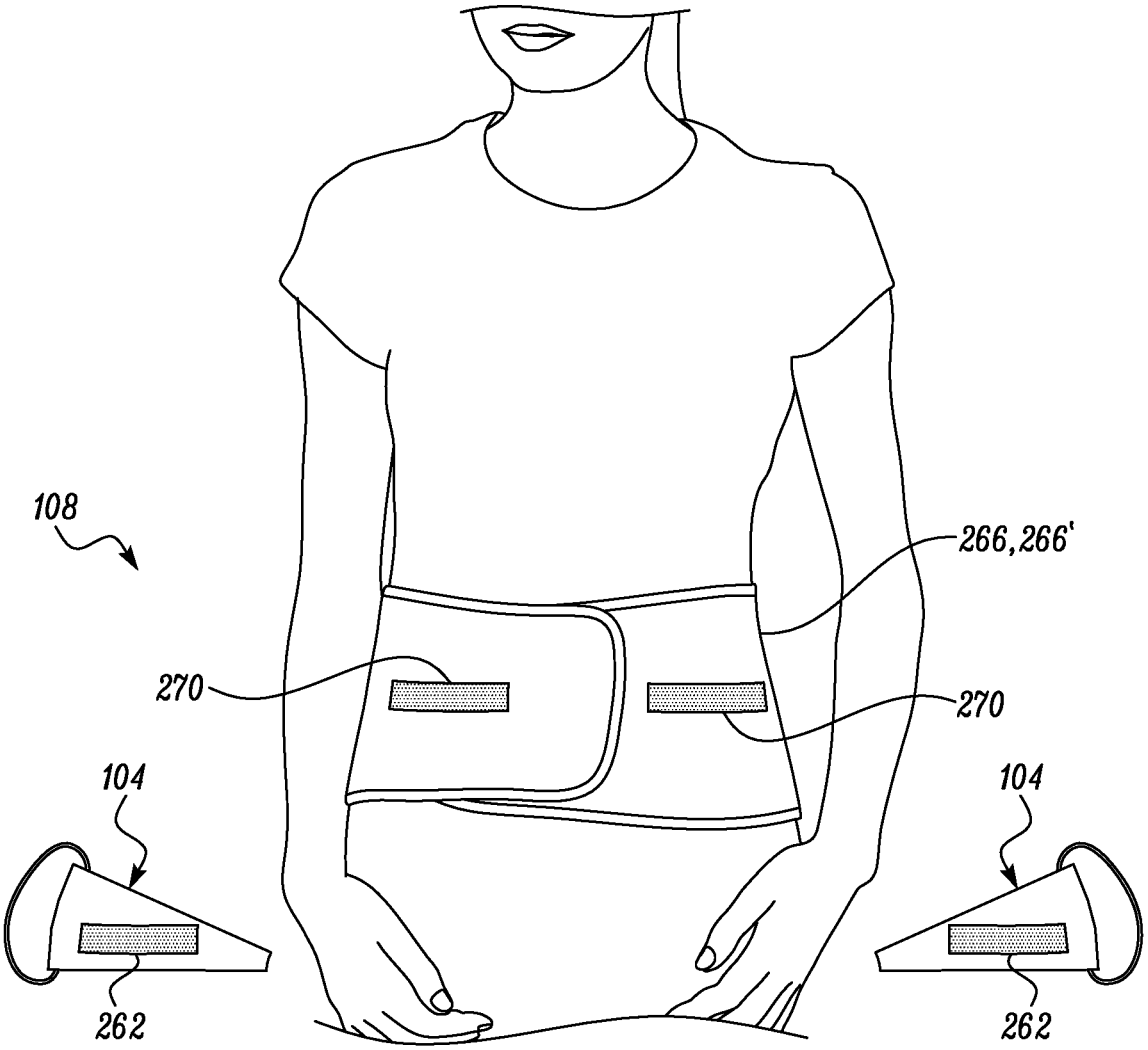

Referring to FIG. 12, the stack 104 can include coupling features 262, such as Velcro, provided outwardly such that by use of such coupling features 262, the stack 104 can be coupled to the body of the user or a caregiver. In such a case, an additional part 266, such as a belt 266', can be used and the same can be wrapped around the user or the caregiver's body (for example, around a waist of the caregiver's body) and which can include complementing coupling features 270 in relation to the coupling features 262 that enable a coupling between the additional part 266 and the stack 104. Such coupling between the additional part 266 and the stack 104 helps retain the stack 104 in place and prevents the stack 104 from misplacements, for example, during a nursing activity or a breastfeeding activity or a bottle feeding activity. In such a case, the stack 104 and said additional part 266 can be part of the feeding unit 108. The additional part 266 can be made from any material now known or in the future developed. A size, configuration, and/or design of the belt 266', as illustrated in FIG. 12 is exemplary, and, in actual practice or application, a belt having a different size, thickness, configuration, and design, may be used.

Based on the exemplary applications described above, it will be appreciated that the feeding unit 108 is applicable in a variety of orientations and positions for the caregiver, the infant, or for both, and thus includes several other uses and applications than what is described. Accordingly, it will be appreciated that the applications and/or uses described herein are purely exemplary.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element preceded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the description. This method is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

We claim:

1. An adjustable feeding unit for providing adjustable support for a feeding activity, the adjustable feeding unit comprising:

a stack of a plurality of positioning elements mounted one over the other such that the plurality of positioning elements defines a base surface and an angularly raised surface disposed at an angular offset with respect to the base surface, wherein one or more positioning elements of the plurality of positioning elements are removable from the stack to adjust the angular offset between the base surface and the angularly raised surface for varying the angularly raised surface between multiple angular positions with respect to the base surface, thereby angularly elevating a head of an infant between various postures above a stomach of the infant to enable the infant to feed at an optimal feeding angle for the feeding activity, each positioning element of the plurality of positioning elements includes a wedge-shaped body defining an underbody surface, a ramp surface inclined at a wedge angle to the underbody surface, each of the underbody surface and the ramp surface extending from a first end of the wedge-shaped body to a second end of the wedge-shaped body, a cross-sectional area of the wedge-shaped body at the first end is smaller than a cross-sectional area of the wedge-shaped body at the second end and a thickness between the underbody surface and the ramp surface at the first end is smaller than a thickness between the underbody surface and the ramp surface at the second end, the plurality of positioning elements are mounted in the same orientation such that first ends of wedge-shaped bodies of corresponding positioning elements face a first direction and second ends of the wedge-shaped bodies of the corresponding positioning elements face a second direction, opposite to the first direction, and the wedge-shaped body defines a first lateral side surface and a second lateral side surface extending between the underbody surface and the ramp surface, the first lateral side surface and the second lateral side surface define a first concavity and a second concavity, respectively, and each of the first concavity and the second concavity extends from the first end to the second end.

2. The adjustable feeding unit of claim 1, wherein a distance between the first lateral side surface and the second lateral side surface at the first end is smaller than a distance between the first lateral side surface and the second lateral side surface at the second end.

3. The adjustable feeding unit of claim 1, wherein the wedge angle of one positioning element of the plurality of positioning elements is different from the wedge angle of another positioning element of the plurality of positioning elements.

4. The adjustable feeding unit of claim 1, wherein the wedge angle of one positioning element of the plurality of positioning elements is the same as the wedge angle of another positioning element of the plurality of positioning elements.

5. The adjustable feeding unit of claim 1, wherein the first end defines a first end surface and the second end defines a second end surface, wherein the first end surface is parallel to the second end surface.

6. The adjustable feeding unit of claim 1, wherein the first end defines a first end surface and the second end defines a second end surface, wherein the second end surface includes a bulged surface defining a convexity, wherein the convexity extends from the first lateral side surface to the second lateral side surface.

7. The adjustable feeding unit of claim 6, wherein the second end surface defines a cutout.

8. The adjustable feeding unit of claim 1, further comprising a pliant sheet to cover the stack and retain the stack as a single unit.

9. The adjustable feeding unit of claim 1 further comprising one or more elevating elements to elevate the stack.

10. The adjustable feeding unit of claim 1, wherein one or more positioning elements of the plurality of positioning elements includes a slit, the adjustable feeding unit further comprising a closed loop flexible member passed through the slit to serve as a grab handle for the stack, and each positioning element of the plurality of positioning elements is coupled to an adjoining positioning element of the plurality of positioning elements using a hook and loop type fastener, such as the one sold under the Trademark of Velcro, to form the stack.

11. The adjustable feeding unit of claim 1, wherein the feeding activity corresponds to a breastfeeding activity and the adjustable feeding unit includes a pillow, the stack configured to elevate and correct a position of the pillow when supporting an infant on the pillow during the breastfeeding activity, wherein the pillow includes one or more pockets to receive and accommodate the stack.

12. The adjustable feeding unit of claim 1, wherein the feeding activity corresponds to a breastfeeding activity and the adjustable feeding unit includes a sheath to receive and accommodate a pillow, the stack configured to elevate and correct a position of the pillow received within the sheath when supporting an infant on the pillow during the breastfeeding activity, wherein the sheath includes one or more pockets to receive and accommodate the stack.

13. The adjustable feeding unit of claim 1, wherein each positioning element of the plurality of positioning elements is formed from one or more of a general foam material, or a medical grade material, or a high density foam material, or a memory foam material, or a plastic material, or a silicone material.

14. An adjustable feeding unit for providing adjustable support for a feeding activity, the adjustable feeding unit comprising:

a stack of a plurality of positioning elements mounted one over the other such that the plurality of positioning elements defines a base surface and an angularly raised surface disposed at an angular offset with respect to the base surface, one or more positioning elements of the plurality of positioning elements including a slit;

a closed loop flexible member passing through the slit; and a pliant sheet to cover the stack and retain the stack as a single unit, wherein one or more positioning elements of the plurality of positioning elements are removable from the stack to adjust the angular offset between the base surface and the angularly raised surface for varying the angularly raised surface between multiple angular positions with respect to the base surface, thereby angularly elevating a head of an infant between various postures above a stomach of the infant to enable the infant to feed at an optimal feeding angle for the feeding activity, at least one of the pliant sheet or the closed loop flexible member serves as a grab handle for the stack, each positioning element of the plurality of positioning elements includes a wedge-shaped body defining an underbody surface, a ramp surface inclined at a wedge angle to the underbody surface, each of the underbody surface and the ramp surface extending from a first end of the wedge-shaped body to a second end of the wedge-shaped body, a cross-sectional area of the wedge-shaped body at the first end is smaller than a cross-sectional area of the wedge-shaped body at the second end and a thickness between the underbody surface and the ramp surface at the first end is smaller than a thickness between the underbody surface and the ramp surface at the second end, the plurality of positioning elements are mounted in the same orientation such that first ends of wedge-shaped bodies of corresponding positioning elements face a first direction and second ends of the wedge-shaped bodies of the corresponding positioning elements face a second direction, opposite to the first direction, and the wedge-shaped body defines a first lateral side surface and a second lateral side surface extending between the underbody surface and the ramp surface, the first lateral side surface and the second lateral side surface define a first concavity and a second concavity, respectively, and each of the first concavity and the second concavity extends from the first end to the second end.

15. A method for providing adjustable support for a feeding activity, the method comprising:

mounting a plurality of positioning elements one over the other such that the plurality of positioning elements forms a stack and defines a base surface and an angularly raised surface disposed at an angular offset with respect to the base surface;

removing one or more positioning elements of the plurality of positioning elements from the stack to adjust the angular offset between the base surface and the angularly raised surface for varying the angularly raised surface between multiple angular positions with respect to the base surface, thereby angularly elevating a head of an infant between various postures above a stomach of the infant to enable the infant to feed at an optimal feeding angle for the feeding activity, wherein each positioning element of the plurality of positioning elements includes a wedge-shaped body defining an underbody surface, a ramp surface inclined at a wedge angle to the underbody surface, each of the underbody surface and the ramp surface extending from a first end of the wedge-shaped body to a second end of the wedge-shaped body, a cross-sectional area of the wedge-shaped body at the first end is smaller than a cross-sectional area of the wedge-shaped body at the second end and a thickness between the underbody surface and the ramp surface at the first end is smaller than a thickness between the underbody surface and the ramp surface at the second end, the plurality of positioning elements are mounted in the same orientation such that first ends of wedge-shaped bodies of corresponding positioning elements face a first direction and second ends of the wedge-shaped bodies of the corresponding positioning elements face a second direction, opposite to the first direction, and the wedge-shaped body defines a first lateral side surface and a second lateral side surface extending between the underbody surface and the ramp surface, the first lateral side surface and the second lateral side surface define a first concavity and a second concavity, respectively, and each of the first concavity and the second concavity extends from the first end to the second end.

16. The method of claim 15 further comprising:

positioning one or more elevating elements in contact with the base surface of the stack to elevate the stack.

17. The method of claim 15 further comprising:

using a pliant sheet to cover the stack and retain the stack as a single unit; and applying the pliant sheet as a grab handle for the stack.

18. The method of claim 15 further comprising:

passing a closed loop flexible member through a slit formed in one or more positioning elements of the plurality of positioning elements; and applying the closed loop flexible member as a grab handle for the stack.

19. The method of claim 15, wherein removing one or more positioning elements of the plurality of positioning elements from the stack reconfigures an angular offset of the stack from defining a first angular offset between the angularly raised surface and the base surface to a second angular offset between the angularly raised surface and the base surface, the second angular offset being different from the first angular offset.

* * * * *